United States Patent [19]

Steiner et al.

[11] Patent Number: 4,540,342

[45] Date of Patent: Sep. 10, 1985

[54] HYDRAULIC SWITCH

[75] Inventors: Charles W. Steiner, Brooklyn Park; Loren J. Simer, Minneapolis, both of Minn.

[73] Assignee: Simer Pump Company, Minneapolis, Minn.

[21] Appl. No.: 665,928

[22] Filed: Oct. 29, 1984

Related U.S. Application Data

[63] Continuation-in-part of Ser. No. 439,284, Nov. 4, 1982, abandoned.

[51] Int. Cl.[3] ..... F04B 49/00

[52] U.S. Cl. ..... 417/40; 200/84 R; 200/84 C

[58] Field of Search ..... 417/40, 28, 26, 38, 417/424, 420; 200/84 R, 84 C

[56] References Cited

U.S. PATENT DOCUMENTS

| | | |
|---|---|---|
| 1,698,693 | 1/1929 | Durdin . |
| 2,483,084 | 9/1949 | Callahan . |
| 2,840,000 | 6/1958 | Gramenzi . |
| 2,844,678 | 7/1958 | Nielsen . |
| 3,316,845 | 5/1967 | Schumann . |
| 3,384,218 | 5/1968 | West . |
| 3,748,066 | 7/1973 | Sully . |
| 3,819,297 | 6/1974 | East . |
| 3,941,073 | 3/1976 | Ridgeway . |
| 3,963,374 | 6/1976 | Sullivan . |
| 4,081,639 | 3/1978 | Tice . |

*Primary Examiner*—Edward K. Look

*Attorney, Agent, or Firm*—Merchant, Gould, Smith, Edell, Welter & Schmidt

[57] ABSTRACT

An hydraulic switch (10) for buoyingly controlling a secondary electrical switch (74) is disclosed. A float (68) is retained to move between a first position spaced apart from a vent opening (64) and a second position in sealing contact with vent opening (64). The electrical switch (74) changes state from an open condition to a closed condition as the float (68) approaches its second position.

6 Claims, 5 Drawing Figures

FIG. 1
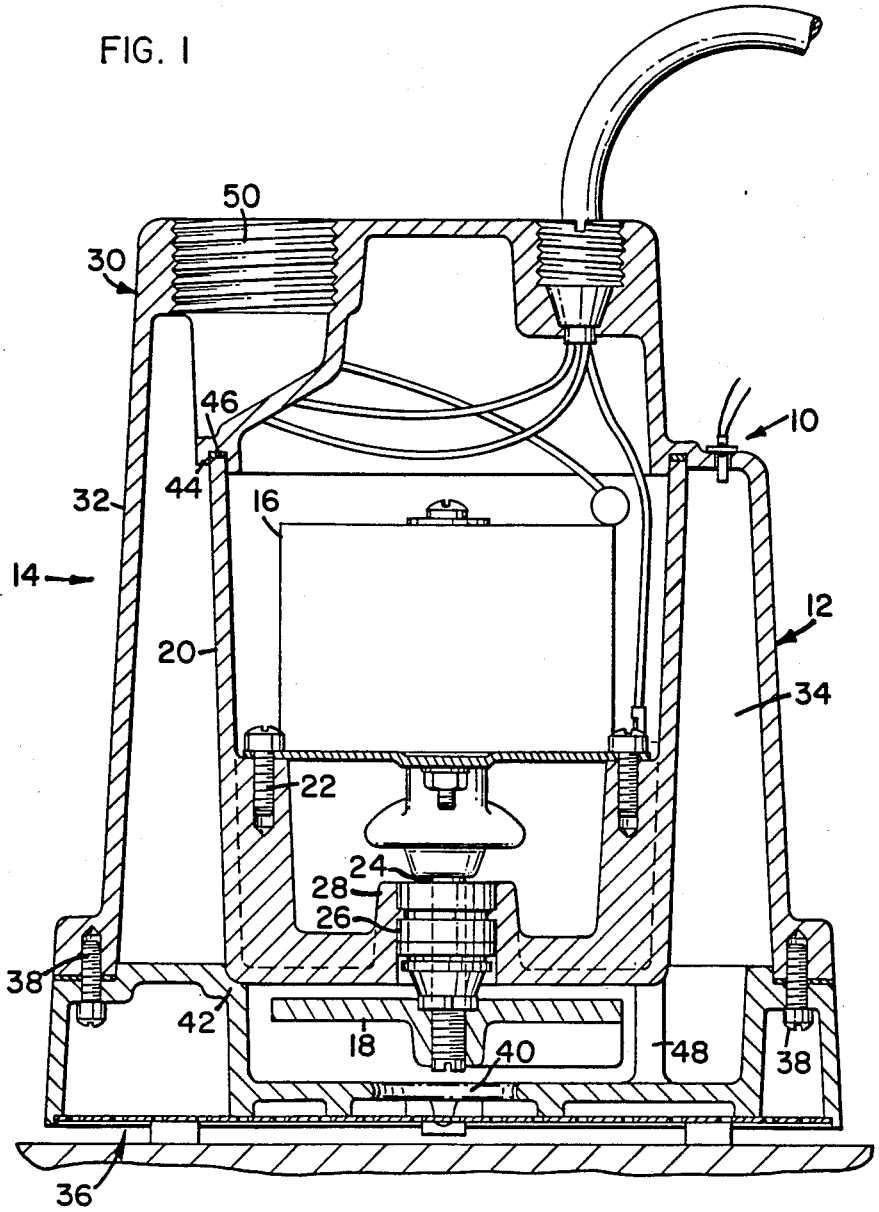
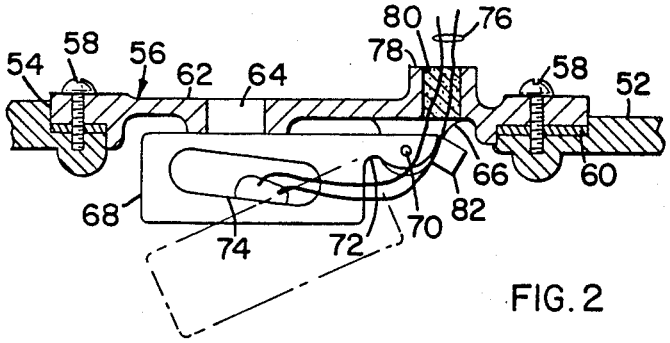
FIG. 2

HYDRAULIC SWITCH

This is a continuation-in-part application of Ser. No. 439,284, filed Nov. 4, 1982 now abandoned.

TECHNICAL FIELD OF THE INVENTION

This invention relates to an hydraulic switch which depends on buoyant sensing of liquid to control an electrical switch. Wherein prior buoyancy sensing switches were generally used to sense relatively static or slowly rising or falling liquid levels, the present switch provides an hydraulic switching mechanism for use within dynamic flow regions.

BACKGROUND OF THE INVENTION

Hydraulic switches having an electrical switch controlled by a buoyant sensor are known. As the buoyant sensor moves from a lower position to a higher position, an electrical switch is closed and a circuit is completed. Prior switches, however, appear to be designed for stand pipes or static tank situations wherein a liquid level rises or falls slowly.

Also, there are switch mechanisms for pumps wherein a float senses liquid within a reservoir or chamber and, consequently, rises or falls to close or open an electrical switch. For example, U.S. Pat. No. 3,316,845 discloses a bilge pump having an enclosure within which a cup chamber contains an electrical motor with a shaft to the pump impeller. Adjacent to the cup chamber is a second chamber within which a float sensor moves along a rod. The float moves between a pair of stops. When the float reaches the top stop, the rod is moved upwardly to close an electrical switch. When the float reaches the bottom stop, the rod is moved downwardly to open the electrical switch. Water enters the enclosure and passes through the lower portion of the second chamber before reaching the pump impeller. As the water level rises within the enclosure, the trapped air compresses and prevents water from passing over the lips of the cup so as to dampen and harm the motor. Thus, this bilge pump must be carefully designed to provide for a proper relationship between impeller speed, size and density of the float, and height of the float chamber relative to the size of the enclosure since such size affects the ultimate air pressure and the height of any rising water.

In a co-pending application assigned to the same assignee as the present application, now issued as U.S. Pat. No. 4,345,879, an hydraulic switch is disclosed which has a fluid line to a float reservoir from the exhaust side of the pump impeller. Although this latter hydraulic switch overcomes the need for close attention to certain design details important for the previously discussed patent, it requires a separate switch reservoir. Hence, the switch is not applicable to many applications.

SUMMARY OF THE INVENTION

The present invention is directed to an hydraulic switch for installation directly within a liquid communication system wherein the liquid communication mechanism has a wall beneath which liquid flows. The hydraulic switch includes an opening in the wall and a lid for the opening. The switch further includes mechanism in the lid for venting gaseous fluids from the liquid communication system. A float is movable between a first position wherein the venting mechanism is open and a second position wherein the float closes the venting mechanism, thereby preventing escape of the liquid. There is mechanism for guiding the float between the first and second positions. An electrical switch for opening and closing an electrical circuit is operable with movement of the float between the first and second positions.

More particularly, the hydraulic switch of the present invention may be a small device readily used with existing plumbing apparatus. Upon providing an opening in an upper or side wall, a lid having the other elements of the hydraulic switch is used to close the opening. The lid includes an opening for venting any pressure increase of gaseous fluid as liquid rises in the plumbing system. When liquid reaches an appropriate level, the float which is attached to the lid moves to a position which causes an electrical switch, for example, a mercury switch, embedded in the float to close thereby causing the pump to begin pumping, which in turn causes the float to move to a position which closes the vent opening and prevent liquid from escaping. The float remains in this position as long as liquid continues to flow or to remain at a level so as to buoy the float. When the liquid no longer fills the space occupied by the hydraulic switch, the float falls away from the vent opening and the mercury switch opens.

The present invention is particularly advantageous since it may be installed in a pump enclosure or any other various plumbing accessories, such as a check valve or simply a connecting tube. Rising liquid buoys the float of the present invention to operate the electrical switch. A vent opening allows gaseous fluids to escape which in turn allows the liquid to rise and the float to be buoyed. Since the present invention is used in dynamic flow paths, it is advantageous to have the vent opening closed to prevent escape from the flow path of any liquid as long as liquid is flowing. Thus, the present invention uses the float to close the vent opening when the float is buoyed and the electrical switch is closed. When the liquid is no longer present for the purpose of buoying the float, the float drops away from the vent opening and opens the electrical switch.

The hydraulic switch exhibits the further advantage that it may not only be incorporated in newly manufactured devices, but is easily retrofitable into existing components and systems.

Furthermore, the switch is simply designed and does not require a separate reservoir or satisfaction of complex system interrelationships.

In this respect, these various advantages and other objects obtained by the use of the present invention are further explained and may be better understood by the reference to the drawings which form a further part of this disclosure and to the accompanying descriptive matter in which there is described in more detail a preferred embodiment of the invention.

BRIEF DESCRIPTION OF THE DRAWINGS

FIG. 1 is a cross-sectional illustration of a submersible pump having an hydraulic switch attached thereto in accordance with the present invention;

FIG. 2 is an enlarged cross-sectional view of a first embodiment of an hydraulic switch in accordance with the present invention;

DETAILED DESCRIPTION OF THE INVENTION

Figure 3:
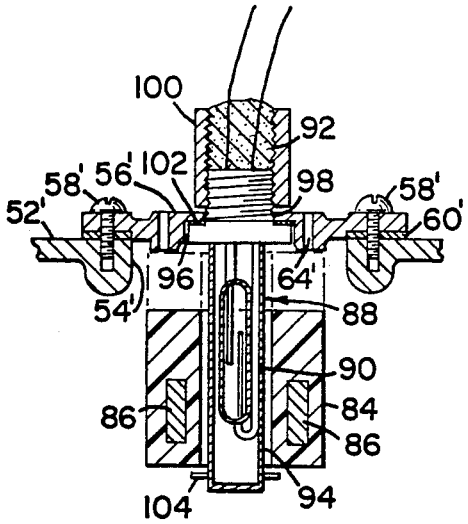
FIG. 3 is a cross-sectional view of a second embodiment of an hydraulic switch in accordance with the present invention.

Referring now to the drawings wherein like reference numerals designate identical or corresponding parts throughout the several views, and more particularly to FIG. 1, an hydraulic switch in accordance with the present invention is designated generally as 10 as attached in a typical application to a submersible pump device 12. Device 12 is comprised of a housing 14 for holding a motor 16 which drives an impeller 18. Housing 14 includes a motor chamber 20 within which motor 16 is fastened with screws 22. Motor shaft 24 extends through a bearing and dynamic seal combination 26 pressed into a boss 28 at the bottom of motor chamber 20. Impeller 18 is attached to the end of shaft 24.

Housing 14 includes an outer shell 30 which has a side wall 32 spaced apart from motor chamber 20. The space 34 between motor chamber 20 and side wall 32 is a cooling water jacket for motor 16 while at the same time being a portion of the exhaust flow path from impeller 18. Cover 36 is attached to the bottom of shell 30 with screws 38. Cover 36 provides an intake opening 40 for impeller 18. Cover 36 also supports motor chamber 20 at shoulder 42 and forces chamber 20 into grooves 44 to compress gasket 46 thereby keeping motor chamber 20 watertight.

Water enters submersible pump device 12 at inlet opening 40 and is forced by impeller 18 through opening 48 in cover 36 into water jacket or space 34. From space 34, water flows to outlet 50 in the upper wall of shell 30.

Submersible pump 12 as described hereinbefore is not a part of the present invention, but rather is illustrative of a device on which hydraulic switch 10 may be used. A device similar to pump 12 is disclosed in U.S. Pat. No. 3,748,066.

An hydraulic switch 10 is shown in FIG. 2. A wall 52 of shell 30 of hydraulic pump device 12 or some other applicable device has an opening 54 therein. On a newly manufactured device 12, opening 54 may be formed during manufacture. For existing devices, opening 54 may be subsequently bored, and an hydraulic switch 10 installed as a retrofit item. Lid 56 is shaped to cover opening 54 and is fastened to wall 52 with appropriate fastening mechanism. In FIG. 2, screws 58 fasten lid 56 to wall 52 having a gasket 60 therebetween. Lid 56 includes a first boss 62 with an opening 64 therein to vent any gaseous fluid from being compressed within the fluid communication system and preventing liquid from rising as required to operate hydraulic switch 10. Lid 56 also includes a tang 66 to which float 68 is pivotally attached with a pin 70. Tang 66 extends beneath lid 56 a sufficient distance to allow an arm 72 attached or integral with float 68 to be pivotally connected therewith.

Float 68 is molded about an electrical switch, such as a mercury switch 74, and, consequently, has a pair of contacts or leads 76 at its outer surface for electrical communication to an external circuit (not shown). Leads 76 pass through a second boss 78 in lid 56. A potting material 80 or some other similar mechanism prevents leakage at the location where leads 76 pass through boss 78.

The lower surface of boss 62 and the upper surface of float 68 conform in order to form a seal between the two surfaces when float 68 is pivoted against boss 62. Arm 72 of float 68 extends beyond pin 70 to provide a stop 82 which limits the pivotal movement of float 68 away from lid 56. Thus, float 68 has a first position wherein float 68 pivots downwardly from lid 56 to a location where stop 82 contacts lid 56 to prevent further pivotal movement. In this first position, the vent opening 64 is open to allow gaseous fluid to escape. As liquid rises toward wall 52, float 68 is pivoted upwardly about pin 70 until it contacts boss 62 and seals vent opening 64. In this sealing position, all the gaseous fluid has escaped and liquid fluid is prevented from escaping. In the first position, switch 74 is open so that any electrical circuit to which switch 74 is connected is also open. In the second position, switch 74 is closed thereby completing any electrical circuit to which switch 74 is connected.

Figure 4:
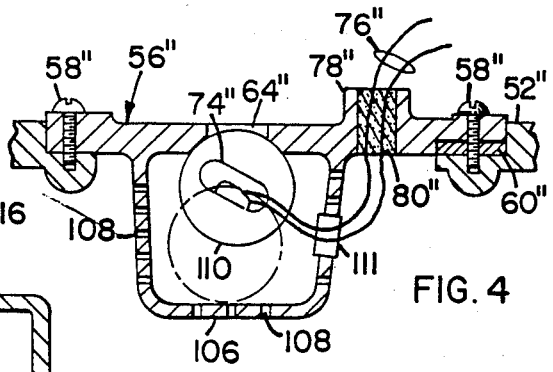
FIG. 4 is a cross-sectional view of a third embodiment of an hydraulic switch in accordance with the present invention.
Figure 5:
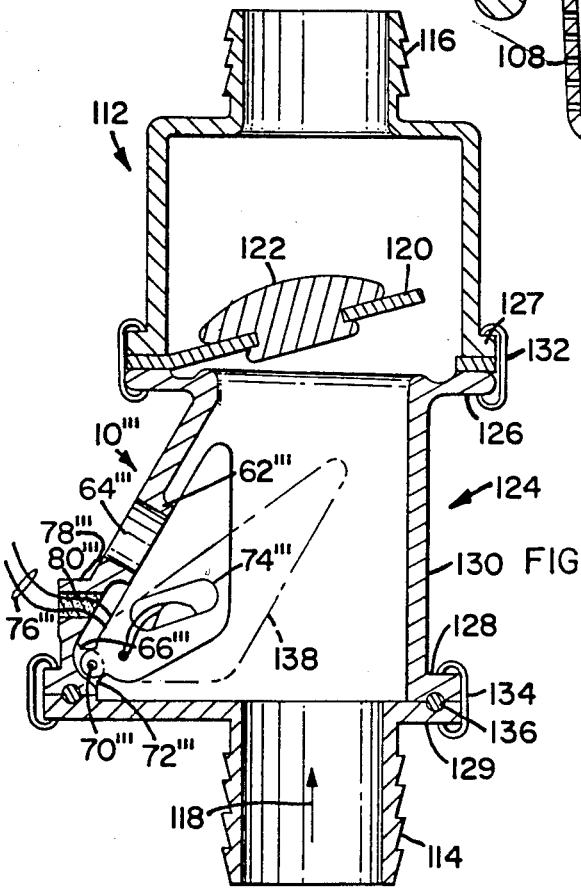
FIG. 5 is a cross-sectional view of a check valve having yet another embodiment of an hydraulic switch in accordance with the present invention incorporated therein.

Additional embodiments of an hydraulic switch in accordance with the present invention are shown in FIGS. 3–5. Each is described hereinafter wherein parts having a similar function as those described in the embodiment of FIG. 2 are identified by the same numeral although distinguished with prime markings. In FIG. 3, a second embodiment is shown with lid 56' covering opening 54' in wall 52'. Lid 56' is fastened with screws 58' to wall 52' having gasket 60' therebetween. Lid 56' includes at least one vent opening 64'. The switch mechanism relates to a float-operated, magnetic-reed type. More particularly, a tubular float 84 carries permanent magnetic elements 86. Float 84 is guided on a fixed vertical stem 88 containing therein a magnetic-reed switch 90. Although this type of float-operated, magnetic-reed switch may be designed in a variety of ways, in FIG. 3, stem 88 includes an upper threaded portion 92 and a lower portion 94 along which float 84 moves. Upper and lower portions 92 and 94 are separated by a shoulder portion 96. Upper threaded portion 92 is inserted from beneath lid 56' through an opening 98 until shoulder portion 96 contacts lid 56' to prevent further insertion. Nut 100 is threaded onto upper portion 92 to compress gasket 102 between shoulder portion 96 and lid 56' and to hold stem 88 in place relative to lid 56'. Stem 88 further includes a stop element 104 at its end opposite threaded portion 92.

In a first position, float 84 rests on stop 104, and reed switch 90 is open. As liquid rises toward wall 52', float 84 rises along the lower portion 94 of stem 88. As the upper surface of float 84 approaches the lower surface of lid 56', magnet 86 causes reed switch 90 to close thereby completing the electrical circuit to which reed switch 90 is connected. When float 84 is lifted to contact lid 56', it seals vent openings 64' thereby preventing liquid from escaping through the openings 64'.

In a third embodiment as shown in FIG. 4, lid 56'' is attached to wall 52'' with screws 58'' with a gasket 60'' providing a seal between lid 56'' and wall 52''. Lid 56'' includes a vent opening 64'', and boss 78'' has an opening filled with a potting material 80'' through which leads 76'' from an electrical mercury switch 74'' pass. Lid 56'' includes a cage 106 extending beneath lid 56'' and approximately symmetrically centered on vent 64''. Cage 106 includes a plurality of openings 108 through which liquid may freely pass. Retained within cage 106 is float 110 having mercury switch 74'' embedded therein. Leads from mercury switch 74'' extend from float 110 through plug 111 in a wall of cage 106 and thereafter through sealant 80'' in the opening of boss 78'' as indicated hereinbefore. Leads 76'' are connected to an external electrical circuit. Float 110 is retained by cage 106 to move between a first position in which vent opening 64'' and switch 74'' are open, and a position wherein liquid beneath wall 52'' buoys float 110 upperwardly to seal vent opening 64''. Ordinarily, switch 74'' closes as float 110 approaches vent opening 64''. Thus, the lower surface of wall 56'' in the vicinity of vent opening 64'' conforms with the upper surface of float 110. Preferably, float 110 is spherical and lid 56'' has a hemispherical indent centered on opening 64'' for receiving float 110. Cage 106 is shaped so as to direct float 110 into the indent as float 110 moves between its first and second positions.

In a fourth embodiment as shown in FIG. 5, an hydraulic switch 10''' is shown as integrated into a check valve 112. Check valve 112 has input and output nozzles 114 and 116. Liquid ordinarily flows through check valve 112 in the direction of arrow 118. Liquid flowing in a direction counter to arrow 118 causes flap 120 with weight 122 thereon to close thereby preventing further flow. Check valve 112 includes a replaceable insert 124 having flanges 126 and 128 at both ends extending outwardly from wall 130 for mating with similar flanges 127 and 129 on the upper and lower portions of check valve 112, respectively. Insert 130 is held in place by circular clamps 132 and 134 which compress an outer gasket-like surface of flap element 120 and an O-ring seal 136 between mating flanges 126–127 and 128–129, respectively.

Insert 124, as indicated, is replaceable so that a first insert may have a solid wall 130. A second insert 124 may include other components to comprise hydraulic switch 10''' as shown in FIG. 5. Insert 124 has circular ends with the upper end having a smaller diameter than the lower. With respect to generally cylindrical input and output nozzles 114 and 116 of check valve 112, the lower end of insert 124 is off center thereby requiring a portion of wall 130 to be slanted with respect to another portion. Boss 62''' with vent opening 64''' therein is preferably located on the slanted portion of wall 130 for the reason indicated hereinafter.

A float 138 has an arm 74''' which is pivotally attached with pin 70''' to tang 66''' extending inwardly from the slanted portion of wall 130. Float 138 may pivot between a first position wherein vent opening 64''' is open and a second position wherein float 138 makes a sealing contact with the inside surface of boss 62'''. Vent opening 64''' is on the slanted portion of wall 130 to provide a surface against which float 138 may seal. That is, since float 138 is buoyed only upwardly, the undersurface of boss 62''' has at least an inclined orientation so float 138 has something to force against and make the indicated sealing contact.

Mercury switch 74''' is embedded within float 138 and has leads 76''' passing from float 138 through potting material 80''' plugging an opening in boss 78'''. As water flows according to arrow 118 into check valve 112, float 138 is pivoted upwardly from its first position wherein opening 64''' is open to vent gases to its final position wherein opening 64''' is sealed closed to prevent liquid from leaking out. As mercury switch approaches opening 64''', it switches from an open state to a closed state thereby completing the external circuit to which leads 76''' are connected.

To use, hydraulic switch 10 is installed in a pump, check valve or other plumbing component of a system in which liquid commonly rises. As the liquid rises to contact and lift float 68, float 68 and mercury switch 74 or any other similar electrical switch moves from a first position to final position. In the first position, float 68 is spaced apart from vent opening 64 to allow gas fluid to vent from the fluid communication system as liquid rises to avoid pressure build-up. Additionally, in the first position the electrical switch, such as mercury switch 74, is open thereby keeping the electrical circuit to which it is connected open. In a second position, float 68 seals vent opening 64, and the electrical switch, such as mercury switch 74, has changed state to a closed position thereby completing the circuit to which it is connected. The sealing of opening 64 prevents liquid escape. Opening 64 thus advantageously is formed in lid 56 and provides for gas escape but not liquid escape. Note that the switch 74 ordinarily changes state as float 68 approaches or has departed from the final position.

All the embodiments function very similar in that a float moves from a first position to a second position, while in doing so an electrical switch changes state from an open condition to a closed condition. Floats 68 and 138 move about pivots, while float 84 is guided along a stem, and float 110 is retained within a cage. In each case, however, the float seals a vent opening when it moves to its second position, and an electrical switch changes state as the float approaches the vent opening.

The present hydraulic switch is particularly advantageous in that it may be manufactured quite small, and consequently, occupy an insignificant space on a component in a fluid system. Also, the switch may be retrofitted into a variety of components simply by boring an opening in the component and fastening the lid of the switch over the opening. It is preferable, of course, that the switch be installed in a region where the rising fluid will be able to operate the switch and where liquid fluid moving through the system continues to buoy the float until all liquid has passed. The switch is particularly simple and inexpensive, yet highly effective.

Although these numerous characteristics and advantages of the present hydraulic switch, together with details of structure and function, have been described in detail with respect to a few embodiments, it is to be understood that the disclosure is illustrative only. Consequently, any changes made, especially in matters of shape, size and arrangement, to the full extent extended by the general meaning of the terms in which the appending claims are expressed, are with in the principle of the invention.

What is claimed is:

1. An hydraulic switch for installation in liquid communication means, said liquid communication means having a wall with an opening beneath which liquid flows, said hydraulic switch comprising:

a lid for said opening;

first means for attaching said lid to said wall to close said opening;

means in said lid for venting gaseous fluid from said liquid communication means;

a float movable between a first position wherein said venting means is open and a second position wherein said float closes said venting means;

means for guiding said float between said first and second positions;

an electrical switch for opening and closing an electrical circuit, said electrical switch being operable with movement of said float between said first and second positions; and second means for operably attaching said float, said guiding means and said electrical switch on one side of said lid;

whereby said float, said guiding means and said electrical switch are operably installed within said liquid communication means on attachment of said lid to said wall.

2. An hydraulic switch in accordance with claim 1 wherein said venting means includes an opening in said lid, said float being shaped to provide a low pressure seal of said opening when said float is in said second position.

3. An hydraulic switch in accordance with claim 1 wherein said guiding means includes means for pivotally attaching said float to said lid, said electrical switch being attached to and movable with said float.

4. An hydraulic switch in accordance with claim 1 wherein said guiding means includes a retaining wall defining a space within which said float moves between its positions, said electrical switch being attached to and movable with said float.

5. In a circuit for carrying flowing liquid, the combination comprising:

a housing having an input and an output for connecting to said circuit;

means for checking liquid flow in a reverse direction while allowing liquid flow in a forward direction;

a hydraulic switch upstream from said checking means, said hydraulic switch including:

buoyancy means for sensing said liquid, means for venting gaseous fluid, means for guiding said buoyancy means between a first position wherein said venting means is open and a final position wherein said buoyancy means seals said venting means, and an auxiliary switch operable with movement of said buoyancy means between said positions; and means for attaching said checking means and said hydraulic switch between said input and said output of said housing.

6. The combination comprising:

a pump;

an electric motor for driving said pump;

a housing, said housing having a pump compartment and an enclosure for said motor, said enclosure providing for passage of a rotary drive shaft extending from said motor to said pump, said housing including a jacket about at least a portion of said enclosure and through which water from said pump flows before exiting;

an hydraulic switch including:

buoyancy means for sensing liquid in said water jacket, means for venting gaseous fluid from within said water jacket, means for guiding said buoyancy means between a first position wherein said venting means is open and a second position wherein said buoyancy means seals said venting means, and an auxiliary switch for controlling said motor, said auxiliary switch being operable with movement of said buoyancy means between said positions, and means for providing electrical energy through circuit means including said hydraulic switch to power said motor when said buoyancy means is in said second position and said auxiliary switch is closed.

* * * * *